US009599289B2

(12) United States Patent
Imai

(10) Patent No.: US 9,599,289 B2
(45) Date of Patent: Mar. 21, 2017

(54) LIGHT SOURCE AND LIGHTING DEVICE INCLUDING THE SAME

(71) Applicants: CITIZEN ELECTRONICS CO., LTD., Fujiyoshida-shi (JP); CITIZEN WATCH CO., LTD., Nishi-Tokyo-shi (JP)

(72) Inventor: Sadato Imai, Minamitsuru-gun (JP)

(73) Assignees: CITIZEN ELECTRONICS CO., LTD., Yamanshi-Ken (JP); CITIZEN WATCH CO., LTD., Tokyo (JP)

( * ) Notice: Subject to any disclaimer, the term of this patent is extended or adjusted under 35 U.S.C. 154(b) by 481 days.

(21) Appl. No.: 13/667,511

(22) Filed: Nov. 2, 2012

(65) Prior Publication Data

US 2013/0106301 A1 May 2, 2013

(30) Foreign Application Priority Data

Nov. 2, 2011 (JP) ..... 2011-240738

(51) Int. Cl.
*H05B 37/00* (2006.01)
*H05B 39/00* (2006.01)
*H05B 41/14* (2006.01)

(52) U.S. Cl.
CPC ..... *F21K 9/232* (2016.08); *F21Y 2107/30* (2016.08); *F21Y 2115/10* (2016.08)

(58) Field of Classification Search
USPC ..... 315/200, 113, 152
See application file for complete search history.

(56) References Cited

U.S. PATENT DOCUMENTS 5,726,535 A * 3/1998 Yan ..... H05B 33/0803 315/185 R
6,250,775 B1 6/2001 Ratcliffe
7,598,531 B2 * 10/2009 Erchak ..... H01L 33/38 257/91

(Continued)

FOREIGN PATENT DOCUMENTS

JP 2008-103112 A 5/2008
JP 2009-135026 A 9/2009

(Continued)

OTHER PUBLICATIONS

Japanese Notification of Reasons for Refusal of Japanese Patent Application No. 2011-240738 Issued May 19, 2015.

*Primary Examiner* — Adam Houston
(74) *Attorney, Agent, or Firm* — Browdy and Neimark, PLLC

(57) ABSTRACT

In some embodiments, a light source including a first electrode that includes a projection and a depression, a second electrode including a projection and a depression, an insulating layer disposed between the first electrode and the second electrode, and a light-emitting element straddling the insulating layer and disposed on the projection of the first electrode and on the projection of the second electrode. In other embodiments, a lighting device including a base that includes a first terminal and a second terminal that are configured to be electrically connected to the light source to supply current to the light-emitting element. In some embodiments, the lighting device is a lighting bulb, and in other embodiments, the lighting device is tube-shaped.

25 Claims, 12 Drawing Sheets

(56) References Cited

U.S. PATENT DOCUMENTS

| | | | | |
|---|---|---|---|---|
| 8,937,435 | B1 * | 1/2015 | Sutardja | H05B 33/0815 315/219 |
| 2008/0293174 | A1 * | 11/2008 | Lee | H01L 25/0753 438/29 |
| 2011/0163683 | A1 * | 7/2011 | Steele | F21V 7/00 315/192 |
| 2012/0056553 | A1 * | 3/2012 | Koolen | H05B 33/0815 315/291 |
| 2013/0181619 | A1 * | 7/2013 | Tischler | H01L 27/156 315/185 R |
| 2014/0191655 | A1 * | 7/2014 | Kasakura | H05B 33/0803 315/32 |
| 2014/0232288 | A1 * | 8/2014 | Brandes | H05B 33/0803 315/250 |
| 2014/0232289 | A1 * | 8/2014 | Brandes | H05B 33/086 315/250 |

FOREIGN PATENT DOCUMENTS

| | | | | |
|---|---|---|---|---|
| JP | 2010-55993 | A | 3/2010 | |
| JP | 2010-135181 | A | 6/2010 | |
| WO | 2006-070457 | A1 | 7/2006 | |
| WO | WO 2010151600 | A1 * | 12/2010 | H01L 27/156 |

* cited by examiner

LIGHT SOURCE AND LIGHTING DEVICE INCLUDING THE SAME

CROSS-REFERENCE TO RELATED APPLICATION

This application is based on and claims the priority benefit of Japanese Patent Application No. 2011-240738, filed on Nov. 2, 2011, the disclosure of which is incorporated herein by reference in its entirety.

BACKGROUND OF THE INVENTION

Field of the Invention

The present invention relates to a light source including a light-emitting element, and relates to a lighting device including the light source. The lighting device here include lighting lamps, lighting bulbs, lighting tubes and so on.

Description of the Related Art

In recent years, a light-emitting diode elements (hereinafter, referred to as LED element) has been widely used in various lighting devices and electronic devices, because LED element can have a long service life, excellent drive characteristic, and an improved light-emitting efficiency even if it is small in shape. For example, conventional filament lamps have been rapidly replaced by lighting bulbs using an LED element. There are some lighting bulbs using an LED element and provided with a base including terminals that are applicable to conventional lighting fittings and/or lighting systems.

In particular, LED lamps including LED elements to acquire a desired brightness and/or including a heat-release configuration have been proposed (for reference, see JP2009-135026A, JP2010-135181A, JP2008-103112A, and WO2006-070457A).

As an example of a conventional lighting device, FIG. 9 shows an LED lamp 100L that is disclosed in JP2009-135026A. FIG. 10 shows a configuration of an LED module 100 as a conventional light source that is configured to be used in-the LED lamp 100L. The conventional LED lamp 100L includes a heat dissipator 103, an insulator 104, and a bayonet cap 102 as a base having the same structure as a conventional filament bulb. The LED lamp 100L includes the LED module 100 in which a plurality of LED elements 111 are disposed on a circuit substrate 112. The LED module 100 is configured to be mounted on an upper portion of the heat-dissipater 103 and is sealed with a spherical cover 105 made from a light-transmitting resin.

The LED module 100 includes four circuit substrates 112 that are combined as four walls that shape a frame, as shown in FIG. 10, for example. Each circuit substrate 112 is made from an insulating resin, and a plurality of LED elements 111 are mounted on outer surfaces of the frame shape formed by the four circuit substrate 112. The reference number 113 shows electrodes that are provided at inner surfaces of the frame shape formed by the four circuit substrates 112.

The LED elements 111 are configured to be driven by current supplied through the bayonet cap 102, and the spherical cover 105 covering the LED module 100 is configured to be a light-emitting portion of the LED lamp 100L.

FIG. 11 shows a module 200 that is disclosed in WO2006-070457A. The module 200 includes a laminated body 205. The laminated body 205 includes two cuboid-shaped metallic members 203*a* and 203*b* each having flat side surfaces, and an insulating spacer 202 disposed between the flat side surfaces of the metallic members 203*a*, 203*b*. The metallic member 203*a* as a first electrode and the metallic member 203*b* as a second electrode form the laminated body 205, and electronic parts 211 are mounted on the metallic members 203*a* and 203*b*. It is disclosed that LEDs can be used as the electric parts 211. The electronic part 211 mounted on the laminated body 205 has, at a lower surface of the electronic part 211, a pair of electrodes. One electrode of the electronic part 211 is electrically connected to the metallic member 203*a* as the first electrode, and the other electrode of the electronic part 211 is electrically connected to the metallic member 203*b* as the second electrode.

FIG. 12 also shows a module 300 disclosed in WO2006-070457A. The module 300 includes a laminated body 305 which has two cuboid-shaped metallic members 303*a* and 303*b* and an insulating spacer 302 disposed between the metallic member 303*a* and the metallic member 303*b*. The metallic members 303*a* and 303*b* are formed as a pair of first and second electrodes. An electronic part 311 is mounted on the first electrode and the second electrode at a peripheral side surface of the laminated body 305.

As shown in FIG. 11, the insulating spacer 202 is disposed in a linear shape at a center of the laminated body 205. As electrodes of the electronic part 211 are positioned adjacent to positions of the metallic members 203*a* and 303*b*, there is a possibility that light emitted from the electronic part 211 in a direction perpendicular to the linear-shaped insulating spacer 202 is interfered with by electrical connecting portions such as electrodes, wires, and/or solders between the electrodes of the electronic part 211 and the metallic members. If a plurality of electronic parts 211 are aligned in a straight line as shown in FIG. 11, it seems to be preferable if light emitted from the electronic parts 211 in a direction perpendicular to the straight line in which the electronic parts 211 as light-emitting elements are aligned can be efficiently used.

SUMMARY OF THE INVENTION

The present invention is proposed in view of such conventional devices as above-described. Embodiments of the invention provide for a light source and/or a lighting device including the light source. In some embodiments, a light source including a first electrode that includes a projection and a depression, a second electrode including a projection and a depression, an insulating layer disposed between the first electrode and the second electrode, and a light-emitting element straddling the insulating layer and disposed on the projection of the first electrode and on the projection of the second electrode. In other embodiments, a lighting device including a base that includes a first terminal and a second terminal that are configured to be electrically connected to the light source to supply current to the light-emitting element.

DETAILED DESCRIPTION OF EMBODIMENTS

Figure 1:
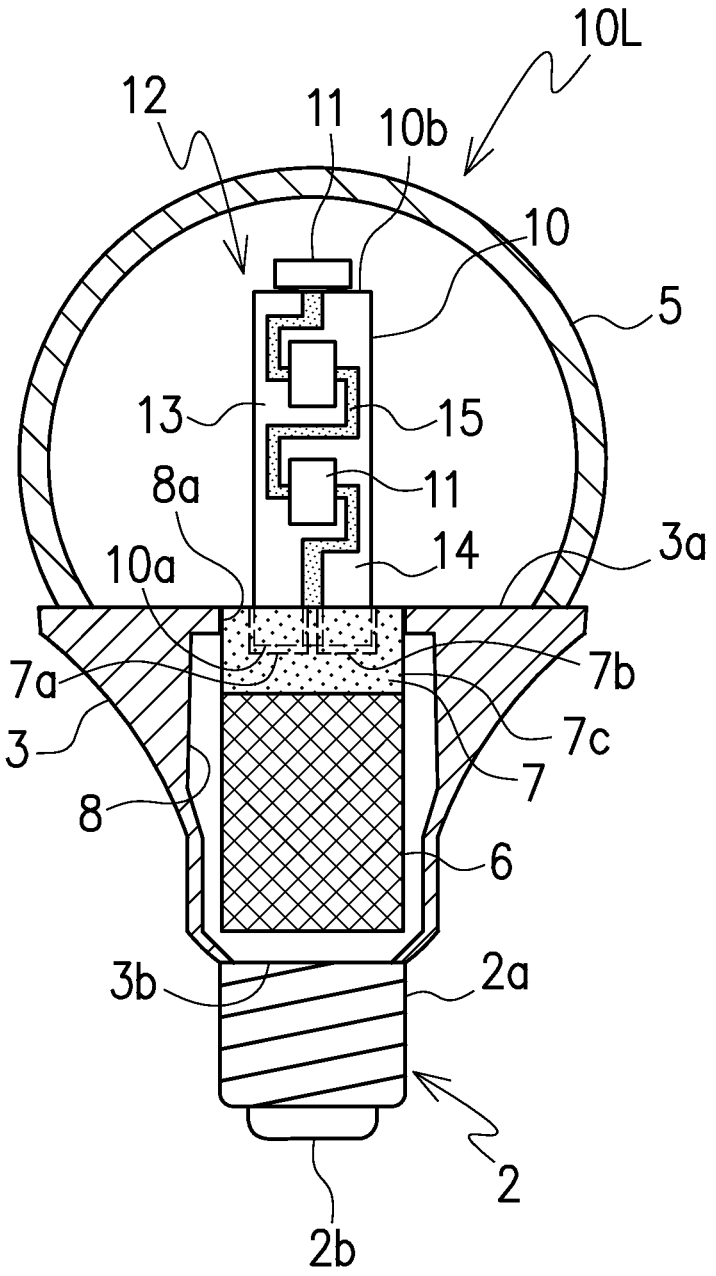
FIG. 1 is a sectional view of a lighting bulb as a lighting device according to a first embodiment of the present invention.

It will be understood that, although the terms first, second, etc. may be used herein to describe various elements and/or various portions of an element, these elements and/or portions should not be limited by these terms. These terms are only used to distinguish one element from another and/or one portion from another of an element. For example, a first element and/or a first portion could be termed a second element and/or a second portion, and, similarly, a second element and/or a second portion could be termed a first element and/or a first portion, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising," "includes", "including", "has" and/or "having" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The following detailed description refers to the accompanying drawings, which illustrate specific embodiments of the invention. Other embodiments including different structures and operation do not depart from the scope of the present invention. Same reference numbers refer to substantially same or similar elements throughout the description of embodiments. It should be noted that the drawings are schematic in nature. Not all parts are always shown to scale.

Briefly, a light source 12 according to some embodiments of the present invention includes a first electrode 13 that includes a projection 13*a* and a depression 13*b*, a second electrode 14 that includes a projection 14*a* and a depression 14*b*, an insulating layer 15 disposed between the first electrode 13 and the second electrode 14, and a light-emitting element straddling the insulating layer 15 and electrically disposed on the projection 13*a* of the first electrode 13 and on the projection 14*a* of the second electrode 14. The projection 13*a* of the first electrode 13 fits in the depression 13*b* of the second electrode 14 on contact with the insulating layer 15, and the projection 14*a* of the second electrode 14 fits in the depression 13*b* of the first electrode 13 on contact with the insulating layer 15 to configure an electrode-assembly 10 of the light source 12. The electrode-assembly 10 here means an assembly including a first electrode, a second electrode, and an insulating layer that electrically insulates the first electrode from the second electrode.

Also, according to an embodiment of a lighting device 10L includes the light source 12, and a connector 7 including a first terminal 7*a* and a second terminal 7*b* to receive the first end 10*a* of the elongated shape of the electrode-assembly 10 included in the light source 12. The first electrode 13 of the electrode-assembly 10 included in the light source 12 is configured to be electrically connected to the first terminal 7*a* of the connector 7 and the second electrode 14 of the electrode-assembly 10 included in the light source 12 is configured to be electrically connected to the second terminal 7*b* of the connector 7.

Figure 2:
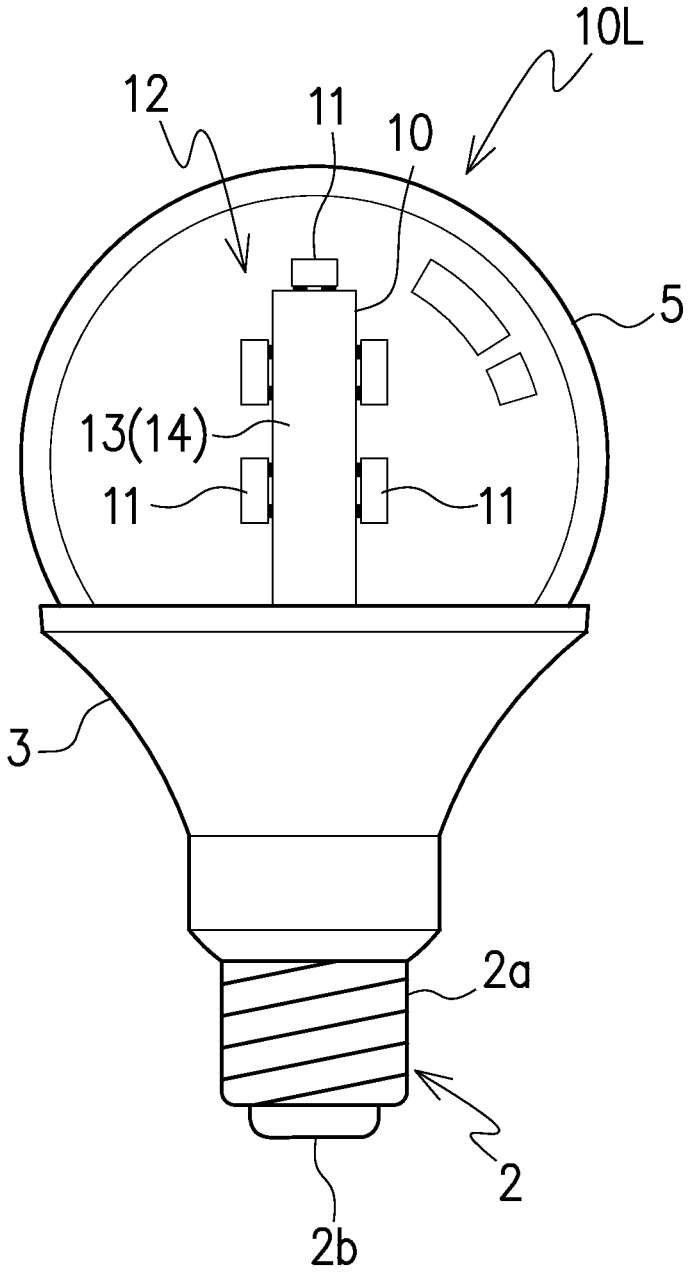
FIG. 2 is a front view of the lighting bulb as the lighting device according to the first embodiment of the present invention.

For more details, FIGS. 1 and 2 show a lighting bulb as a lighting device 10L according to a first embodiment of the present invention. The lighting device 10L includes a light source 12. The light source 12 includes an electrode-assembly 10 and light-emitting elements 11 mounted on the electrode-assembly 10. The light source 12 will be described in further details later. The lighting device 10L further includes a lower cover 3 disposed at a side where a first end 10*a* of the electrode-assembly 10 included in the light source 12 is positioned adjacent, and a base 2 that is disposed under the lower cover 3. The base 2 includes a first terminal 2*a* and a second terminal 2*b*. The base 2 of this embodiment includes a screw fitting. is a bayonet cap. The first terminal 2*a* of the base 2 is positioned at a peripheral side surface of the base 2 and is electrically connected to a first electrode 13 of the light source 12, and the second terminal 2*b* is positioned at a lower surface of the base 2, and electrically connected to a second electrode 14 of the light source 12.

Meanwhile, the lower cover 3 may be made of a metal, and configured to release heat generated from the light-emitting elements 11 to outside of the lighting device 10L.

The lighting bulb 10L in the first embodiment includes an upper cover 5 that includes a dome shape covering from above a second end 10*b* of the electrode-assembly 10 (upper end of the electrode-assembly 10 as shown in FIG. 1) of the light source 12. The dome shape of the upper cover 5 may include a semi-spherical shape or a spherical shape. The dome shape of the upper cover 5 is configured to be a light-emitting portion of the lighting bulb 10L as a lighting device.

The upper cover 5 may be made from a light-transmitting resin. The upper cover 5 may be made from a transparent resin or a translucent resin. Of course, the upper cover 5 may be made from a glass.

In this embodiment, the electrode-assembly 10 included in the light source 12 includes an elongated shape with the first end 10*a* and the second end 10*b* that is positioned at an opposite side of the first end 10*a* of the elongated shape of the electrode-assembly 10. The upper cover 5 covers from above the second end 10*b* of the elongated shape of the electrode-assembly 10 included in the light source 12. The lower cover 3 may include a tube or a cup shape whose cross-section becomes larger at a position adjacent to the first end 10*a* of the electrode-assembly 10 included in the light source 12 than at a position adjacent to the base 2 that is positioned under the lower cover 3. The lower cover 3 may include an inverted bell shape with indentations formed around a peripheral surface of the lower cover 3 to effectively release heat generated from the light-emitting elements 11. The lower cover 3 positioned between the upper cover 5 and the base 2 may include an opening 8 passing through the lower cover 3 from an upper side 3*a* to a lower side 3*b* of the lower cover 3.

In this embodiment, the opening 8 may include a column-shaped hollow. The first end 10*a* of the elongated shape of the electrode-assembly 10 included in the light source 12 is inserted in the opening 8 of the lower cover 3 from the upper side 3*a* of the lower cover 3.

The lighting bulb 10L may be configured to include a circuit 6 that is positioned in the opening 8 of the lower cover 3 and electrically connected to the first electrode 13 and the second electrode 14 of the electrode-assembly 10 included in the light source 12. The circuit 6 may include a converter circuit that converts alternating current to direct current that is configured to drive the light-emitting elements 11 mounted on the first electrode 13 and the second electrode 14 of the electrode-assembly 10 included in the light source 12. The base 2 is positioned under the circuit 6 at the lower side 3*b* of the lower cover 3 and positioned outside the opening 8 of the lower cover 3. The base 2 further includes a first terminal 2*a* and a second terminal 2*b* that is configured to supply alternating current to the circuit 6. In this embodiment, the base 2 is a bayonet cap through that alternating current may be supplied.

Moreover, the lighting bulb 10L may be configured to include a connector 7, as shown in FIG. 1. In this embodiment, the connector 7 includes a first terminal 7*a* and a second terminal 7*b* and is positioned in the opening of the lower cover 3. The connector 7 here is disposed between the light source 12 and the circuit 6, and the connector 7 electrically connects the first electrode 13 and the second electrode 14 of the electrode-assembly 10 included in the light source 12 to the circuit 6. The circuit 6 in this embodiment is positioned under the connector 7 in the opening 8 of the lower cover 3. The first end 10*a* (lower end in FIG. 1) of the electrode assembly 10 is disposed in the opening 8 of the lower cover 3, and the first end 10*a* of the electrode-assembly 10 is disposed in contact with the connector 7.

In this embodiment, the connector 7 includes an outer peripheral surface 7*c* that is configured to be in contact with the lower cover 3. For example, the outer peripheral surface 7*c* of the connector 7 is in contact with an upper portion of an inner peripheral surface 8*a* of the lower cover 3 that can be made from metal as a whole or can include a metal portion to release heat generated from the light-emitting element 11 to outside of the lighting bulb 10L. The inner peripheral surface 8*a* demarcates the opening 8 of the lower cover 3.

Figure 3A:
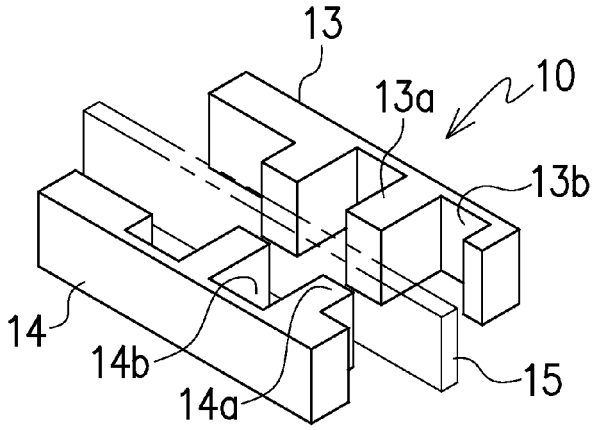
FIG. 3A is an exploded perspective view of a first electrode and a second electrode of an electrode-assembly included in a light source, according to a first embodiment of the light source according to the present invention.

FIG. 3A shows a configuration of an electrode-assembly 10 included in a light source 12. The electrode-assembly 10 includes a first electrode 13 and a second electrode 14. The first electrode 13 includes a projection 13*a* and a depression 13*b*, and the second electrode 14 includes a projection 14*a* and a depression 14*b*. The electrode-assembly 10 further includes an insulating layer 15 that is disposed between the first electrode 13 and the second electrode 14.

Figure 3B:
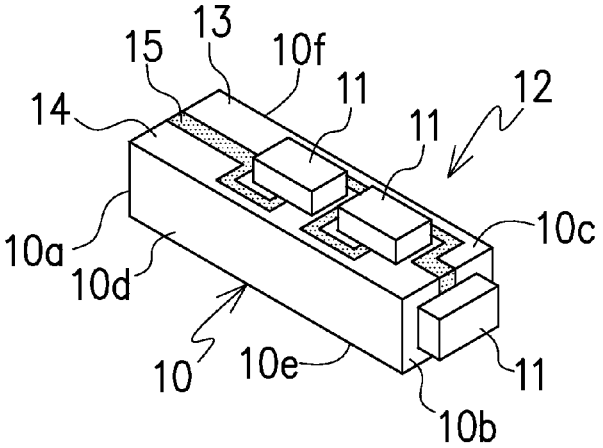
FIG. 3B is a perspective view of the light source including a plurality of light-emitting elements.
Figure 3C:
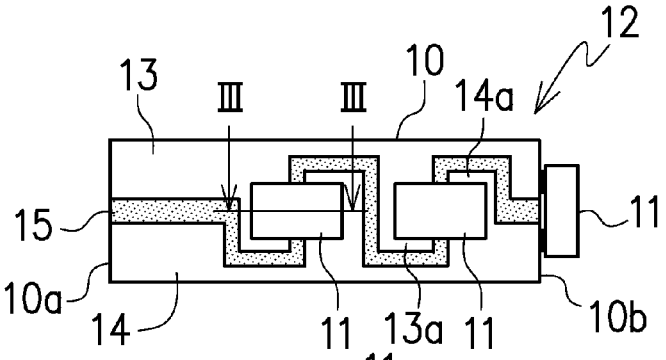
FIG. 3C is a plan view of the light source as shown in FIG. 3B and including the plurality of light-emitting elements electrically connected to the first electrode and the second electrode of an electrode-assembly.
Figure 3D:
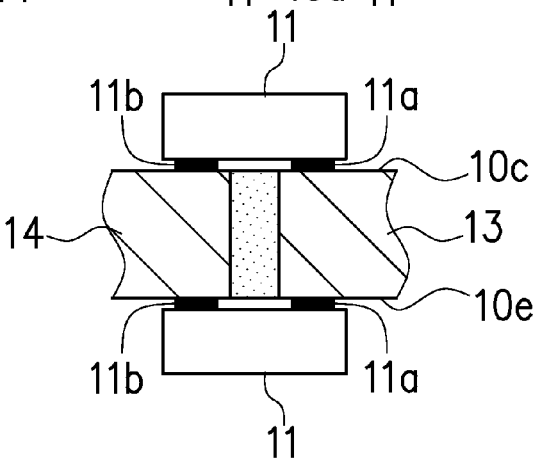
FIG. 3D is a sectional enlarged view taken along line III-III of the light source shown in FIG. 3C.

For more details, the insulating layer 15 is sandwiched between the projection 13*a* and the depression 13*b* of the first electrode 13 and the projection 14*a* and the depression 14*b* the second electrode 14, as shown in FIGS. 3B-3D. The projection 13*a* of the first electrode 13 fits in the depression 14*b* of the second electrode 14 on contact with the insulating layer 15. The projection 14*a* of the second electrode 14 fits in the depression 13*b* of the first electrode 13 on contact with the insulating layer 15. The insulating layer 15 includes a shape corresponding to the projections and depressions of the first electrode 13 and the second electrode 14. A light-emitting element 11 straddles the insulating layer 15 and disposed on the projection 13*a* of the first electrode 13 and on the projection 14*a* of the second electrode 14.

In another embodiment of a light source 12, the first electrode 13 may include projections 13*a* and depressions 13*b*, and the second electrode 14 may include projections 14*a* and depressions 14*b*. For more details, the first electrode 13 includes projections 13*a* and depressions 13*b* at a side surface of the first electrode 13. The second electrode 14 includes projections 14*a* and depressions 14*b* at a side surface of the second electrode 14. The insulating layer 15 is sandwiched between the projections 13*a* and the depressions 13*b* of the first electrode 13 and the projections 14*a* and the depressions 14*b* the second electrode 14. In this embodiment, a plurality of light-emitting elements 11 may be provided on the electrode-assembly 10. Each of the light-emitting elements 11 straddles the insulating layer 15 and disposed on each of the projections 13*a* of the first electrode 13 and on each of the projections 14*a* of the second electrode 14.

The electrode-assembly 10 including the first electrode 13 and the second electrode 14 with the insulating layer 15 sandwiched by the first electrode 13 and the second electrode 14 includes an elongated shape with a first end 10*a* and a second end 10*b* that is positioned at an opposite side of the first end 10*a* of the elongated shape of the electrode-assembly 10. In this embodiment, the elongated shape of the electrode-assembly 10 is configured to be a rectangular parallelepiped as a whole.

The electrode-assembly 10 includes the first end 10*a*, the second end 10*b* positioned at the opposite side of the first end 10*a*, and peripheral side surfaces 10*c*, 10*d*, 10*e*, 10*f* between the first end 10*a* and the second end 10*b* of the electrode-assembly 10. The light-emitting elements 11 that straddle the insulating layer 15 and are mounted on the projections 13*a* of the first electrode 13 and on the projections 14*a* of the second electrode 14 are aligned in a straight line at a first side surface 10*c* of the peripheral side surfaces 10*c*, 10*d*, 10*e*, 10*f* of the electrode-assembly 10, as shown in FIGS. 3B-3D. The light-emitting elements 11 may be provided on a second side surface 10*e* of the peripheral side surfaces 10*c*, 10*d*, 10*e*, 10*f* of the electrode-assembly 10, as shown in FIGS. 2 and 3D. The light-emitting elements 11 that straddle the insulating layer 15 and are mounted on the projections 13*a* of the first electrode 13 and on the projections 14*a* of the second electrode 14 are aligned in a straight line at a second side surface 10*e* that is positioned at an opposite side of the first side surface 10*c* of the peripheral side surfaces 10*c*, 10*d*, 10*e*, 10*f* of the electrode assembly 10.

Furthermore, as shown in FIGS. 1-2, 3B-3D, and FIG. 4, one or more of the light-emitting elements 11 straddle the insulating layer 15 and is mounted on the first electrode 13 and the second electrode 14 at the second end 10*b* of the elongated shape of the electrode-assembly 10. The insulating layer 15 may be formed by an insulating sheet material or adhesive layer.

In this embodiment, the light-emitting elements 11 mounted on the first electrode 13 and the second electrode 14 are LED elements. Each of the LED elements includes a p-electrode 11*a* and an n-electrode 11*b* that is configured to form a p-n junction. The p-electrode 11*a* may be directly disposed on the first electrode 13 of the element-assembly 10 and the n-electrode 11*b* may be directly disposed on the second electrode 14 of the element-assembly 10. In a variation of an embodiment, the light-emitting element 11 may be formed as a light-emitting package 11' including a substrate 11*c* with an anode electrode 11*a*' and a cathode electrode 11*b*' and including a light-emitting diode element 11 that is mounted on the substrate 11*c* and electrically connected to the anode electrode 11*a*' and the cathode electrode 11*b*' of the substrate 11*c*, as shown in FIG. 6E.

In the lighting bulb 10L according to the first embodiment, two light-emitting elements 11 are mounted in an electrically connected state on a first side surface 10*c* of peripheral side surfaces of an assembly of the first electrode 13 and the second electrode 14 as fitted, and two light-emitting elements 11 are mounted in an electrically connected state on a second side surface 10*e* opposite to the first side surface 10*c*, as shown in FIGS. 3B and 3D. As shown in FIGS. 1 to 3, not only the peripheral side surfaces of an assembly of the first electrode 13 and the second electrode 14 as fitted through the insulating layer 15, but also one light-emitting element 11 is provided on the second end 10*b*. However, the number of light-emitting elements 11 is not limited in the number of light-emitting elements 11 as shown in embodiments. The number of the light-emitting elements 11 may change in accordance with the shape of the element-assembly 10, and/or an arrangement of the light-emitting elements 11, and/or the shape of a lighting device 10L including the light source 12.

The light-emitting element 11 includes a p-electrode 11*a* and an n-electrode 11*b*. The p-electrode 11*a* of the light-emitting element 11 is configured to be electrically connected to the projection 13*a* of the first electrode 13, and the n-electrode 11*b* of the light-emitting element 11 is electrically connected to the projection 14*a* of the second electrode 14. The p-electrode 11*a* of the light-emitting element 11 may be directly disposed on the projection 13*a* of the first electrode 13, and the n-electrode 11*b* of the light-emitting element 11 may be directly disposed on the projection 14*a* of the second electrode 14.

Figure 4:
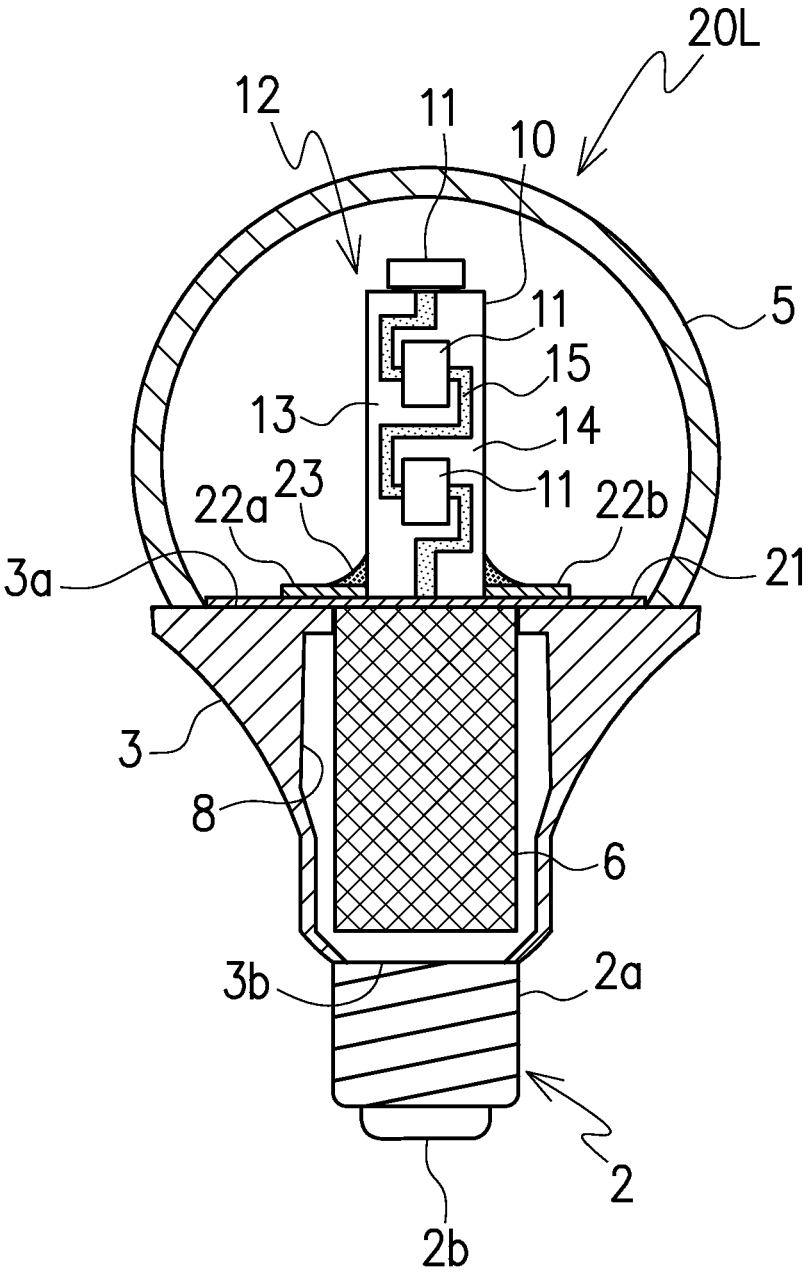
FIG. 4 is a sectional view of a lighting bulb as a lighting device according to a second embodiment of the present invention.

FIG. 4 shows a lighting bulb 20L as a lighting device according to a second embodiment of the present invention.

The lighting bulb 20L according to this embodiment differs from that of the first embodiment in that a substrate 21 is disposed on an upper side 3*a* of the lower cover 3, and current is supplied to the electrode-assembly 10 of the light source 12 through a first wiring electrode 22*a* and a second wiring electrode 22*b* provided on the substrate 21. The substrate 21 is electrically connected to a circuit 6 that is positioned in an opening 8 of the lower cover 3 under the substrate 21 and supplies current from a base 2 to the substrate 21. The electrode-assembly 10 is positioned on an upper surface of the substrate 21 with the first electrode 13 electrically connected and adhered to the first wiring electrode 22*a* of the substrate 21 by soldering 23 and with the second electrode 14 electrically connected and adhered to the second wiring electrode 22*b* of the substrate 21 by soldering 23. Accordingly, the substrate 21 supports the light source 12 on the upper surface of the substrate 21. In this embodiment, as the substrate 21 is in contact with the lower cover 3 that is made from a metal, it is possible for the substrate 21 to include a thermally connecting portion to the lower cover 3 to release heat generated from the light-emitting elements 11 efficiently. Because other basic structure of the lighting bulb 20L is substantially similar to the lighting bulb 10L in the first embodiment, the identical reference numbers are attached to similar parts to that of the lighting bulb 10L, a further detailed description is omitted.

Also, it is possible to improve brightness of the lighting bulb 20L with the first wiring electrode 22*a* and the second wiring electrode 22*b*, because they can be formed as metal layers, and also a white reflective layer may be provided on the upper surface of the substrate 21 to reflect light from the light source 12 upward.

Figure 5:
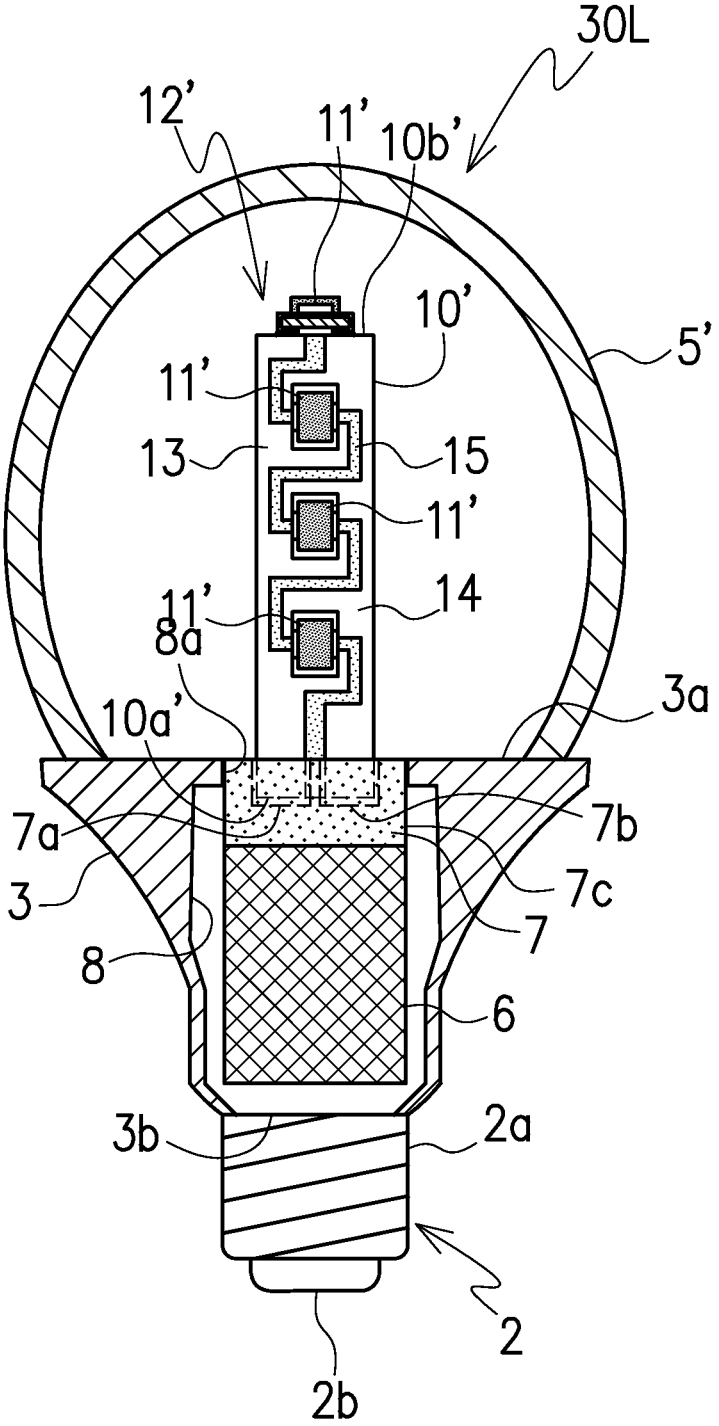
FIG. 5 is a sectional view of a lighting bulb as a lighting device according to a third embodiment of the present invention.

FIG. 5 shows a lighting bulb according to a third embodiment of the present invention.

In the lighting bulb 30L according to this embodiment, a structure of a light-emitting element 11' included in a light source 12' differs from that of the light-emitting elements 11 according to the first embodiment.

The light-emitting element here is a light-emitting package 11' including a substrate 11*c* with an anode electrode 11*a*' and a cathode electrode 11*b*', and an-LED element 11 that is mounted on the substrate 11*c* and electrically connected to the anode electrode 11*a*' and the cathode electrode 11*b*' of the substrate 11*c*, as shown in FIG. 5, FIGS. 6B-6E.

Figure 6A:
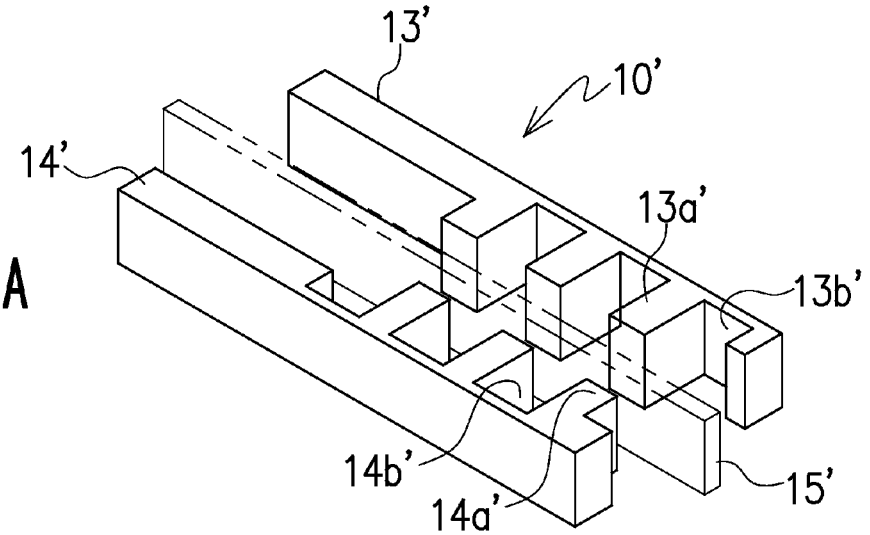
FIG. 6A is an exploded perspective view of a first electrode and a second electrode of an electrode-assembly included in a light source according to a second embodiment of the light source used in the lighting device as shown in FIG. 5.

For more details, FIG. 6A is an exploded perspective view of a first electrode 13' and a second electrode 14' of an electrode-assembly 10' included in a light source 12' as shown in FIG. 4, according to a second embodiment of the light source used in the lighting device as shown in FIG. 5.

Figure 6B:
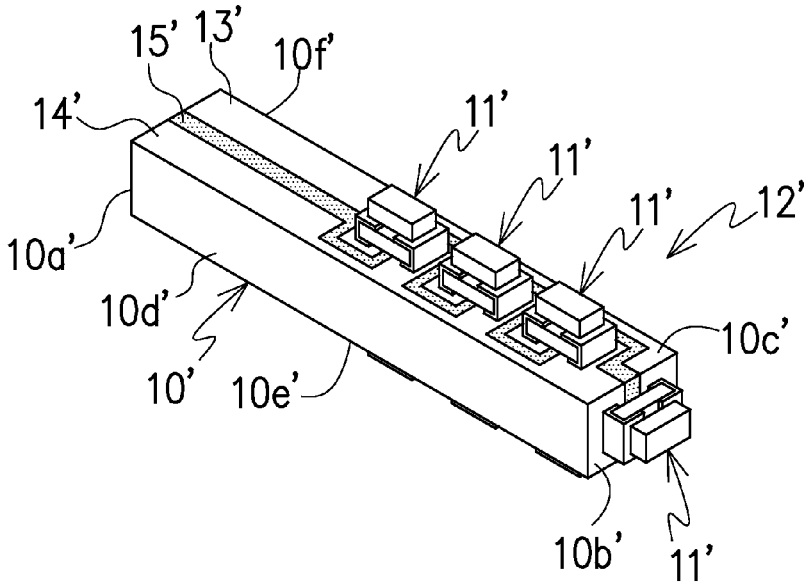
FIG. 6B is a perspective view of the light source including a plurality of light-emitting elements electrically mounted on the first electrode and the second electrode, in the second embodiment.

FIG. 6B is a perspective view of the light source 12' including a plurality of light-emitting packages 11' as light-emitting elements electrically mounted on the first electrode 13*a*' and the second electrode 14', according to the second embodiment of a light source of the present invention. For more details, the light-emitting package 11' as a light-emitting element straddles the insulating layer 15 on the projection 13*a*' of the first electrode 13' and on the projection 14*a*' of the second electrode 14', with the anode electrode 11*a*' in contact with the projection 13*a*' of the first electrode 13' and with a cathode electrode 11*b*' in contact with the projection 14*a*' of the second electrode 14'.

Figure 6C:
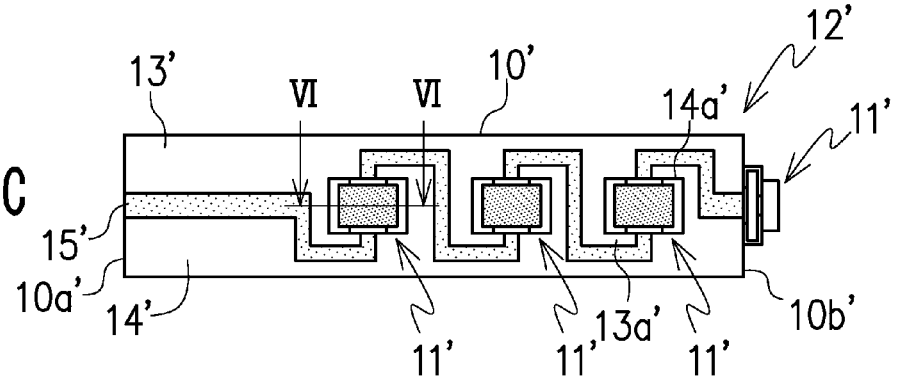
FIG. 6C is a side view of the light source shown in FIG. 6B and including the plurality of light-emitting elements electrically mounted on the first electrode and the second electrode.

FIG. 6C is a side view of the light source shown in FIG. 6B and including the plurality of light-emitting elements 11' electrically mounted on the first electrode 13' and the second electrode 14'.

Figure 6D:
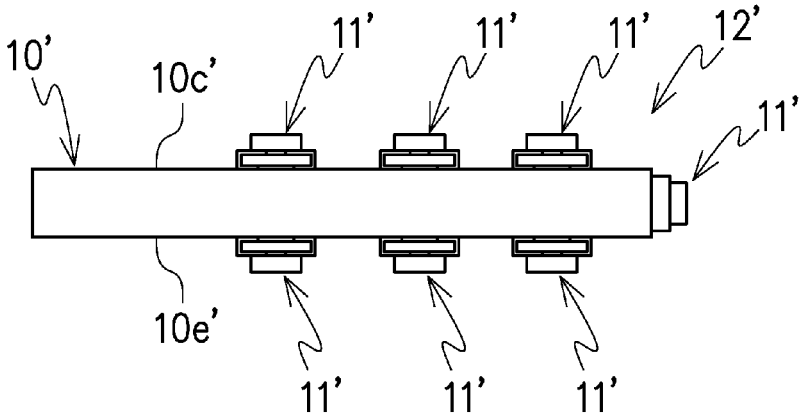
FIG. 6D is a side view of the light source shown in FIG. 6B, showing a different side view from the side view shown in FIG. 6C.
Figure 6E:
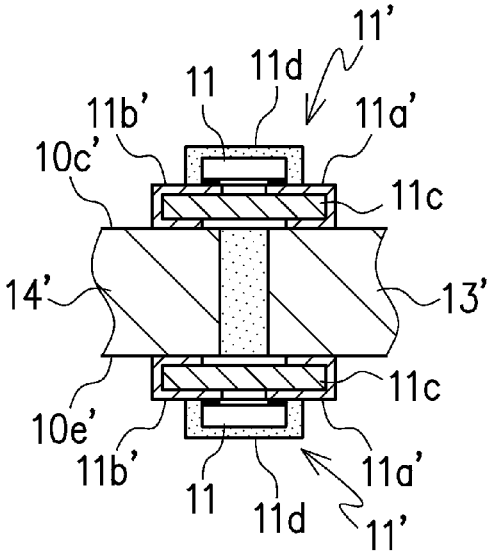
FIG. 6E is a sectional view taken along line VI-VI of the light source shown in FIG. 6B.

FIG. 6D is a side view of the light source shown in FIG. 6B, showing a different side view from the side view shown in FIG. 6C.

In this embodiment, the light-emitting element 11' may include a light-transmitting resin 11*d* including a phosphor covering a light-emitting diode element 11.

Meanwhile, in the lighting bulb 30L according to the third embodiment, because a configuration in that a light-emitting package 11' is used as a light-emitting element differs from that of the LED elements 11 in the first embodiment, and other basic structure is substantially similar to that of the lighting bulb 10L in the first embodiment, identical and/or similar reference numbers are attached to an element and an portion of an element that is identical and/or similar to that of the lighting bulb 10L, and a further detailed description is omitted.

Figure 7:
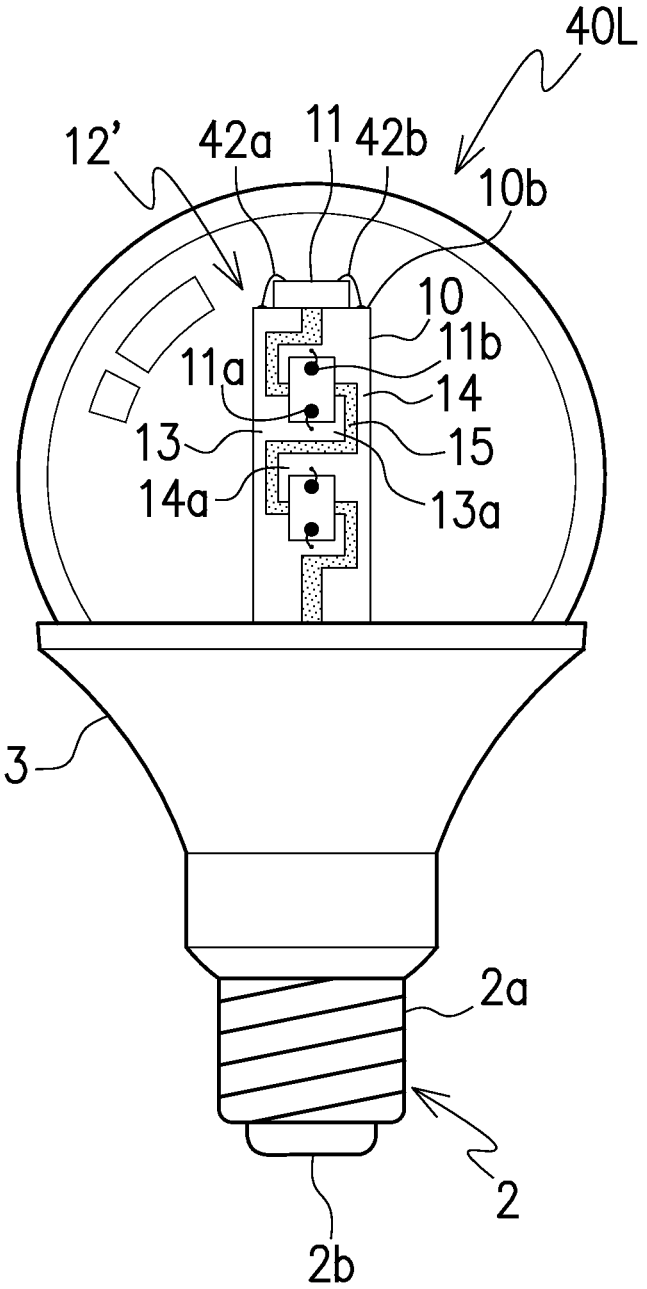
FIG. 7 is a front view of a lighting bulb as a lighting device according to a fourth embodiment of the present invention.

FIG. 7 illustrates a lighting bulb as a lighting device according to a fourth embodiment of the present invention.

In the lighting bulb 40L according to this embodiment, the light-emitting element 11 is a light-emitting diode element including a p-electrode 11*a* and a n-electrode 11*b* on a surface that faces the upper cover 5. In this embodiment the p-electrode 11*a* is electrically connected by a metallic wire 42*a* to the first electrode 13 and the n-electrode 11*b* is electrically connected by a metallic wire 42*b* to the second electrode 14. In this configuration, even if the electrical connection between the light-emitting element 11 and the electrode-assembly 10 is a metallic wire, light emitted from the light-emitting element 11 in a direction perpendicular to a straight line, in that the light-emitting elements 11 are aligned, is not interfered with by the electrical connection, because of the configuration of the electrode-assembly 10 included in the light source 12.

In the fourth embodiment, the electrical connection between the light-emitting element 11 and the projection 13*a* of the first electrode 13, and the electrical connection between the light-emitting element 11 and the projection 14*a* of the second electrode 14 in the light source 12' differs from that in the light source 12 of the first embodiment, other basic structure as a lighting device of the lighting bulb 40L is substantially similar to the lighting bulb 10L of the first embodiment. Therefore, an identical reference number is attached to an element and/or a portion same and/or similar to that of the lighting bulb 10L, and a further detailed description is omitted.

The mount structure of the LED elements 11 in the fourth embodiment is applicable to the lighting bulb 10L according to the first embodiment and the lighting bulb 20L according to the second embodiment. In addition, the lighting bulb in each of the first to fourth embodiments, the upper cover 5 sealing the light source has the same shape as a conventional bulb. However, the lighting bulb may include a bayonet cap, and a shape is not limited to the spherical or semi-spherical shape. Consequently, the embodiments of the present invention are applicable to bulbs or lamps having various shapes such as a cylinder shape, a rectangular shape and so on.

As mentioned above, the electrode-assembly 10' of the light source 12' in the lighting bulb 30L can be in the shape of a rectangular parallelepiped, but the shape of the electrode-assembly 10 is not limited to this shape. The electrode-assembly 10 may be configured to be in the shape of quadrangular prism, a cube, or a plate shape as a whole. When the electrode-assembly 10 is a plate shape as a whole, the first electrode 13 includes a cut portion that is configured to be a depression 13*b* and a portion between cut portions being configured to be a projection 13*a* of the first electrode 13, and the second electrode 14 includes a cut portion that is configured to be a depression 14*b* and a portion between cut portions being configured to be a projection 14*a* of the second electrode 14. In this embodiment, the first electrode 13 is a metallic plate with a cut portion, and the second electrode 14 is also a metallic plate with a cut portion, and the first electrode 13 and the second electrode 14 are configured to be a single plate shape with the projection 13*a* of the first electrode 13 fitting in the depression 14*b* of the second electrode 14 on contact with an insulating layer 15 and with the projection 14*a* of the second electrode 14 fitting in the depression 13*b* of the first electrode 13 on contact with the insulating layer 15. The insulating layer 15 combines the first electrode 13 and the second electrode 14 and electrically insulates each other of the first electrode 13 and the second electrode 14 of the electrode-assembly.

Figure 8:
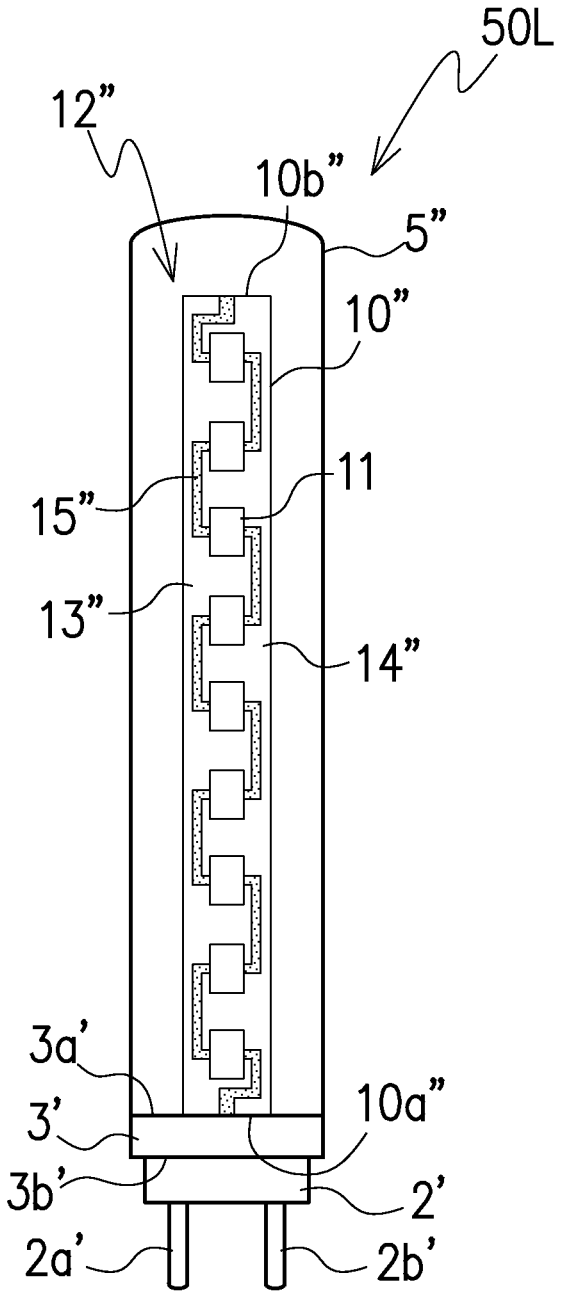
FIG. 8 is a front view of a lighting bulb as a lighting device according to a fifth embodiment of the present invention.
Figure 9:
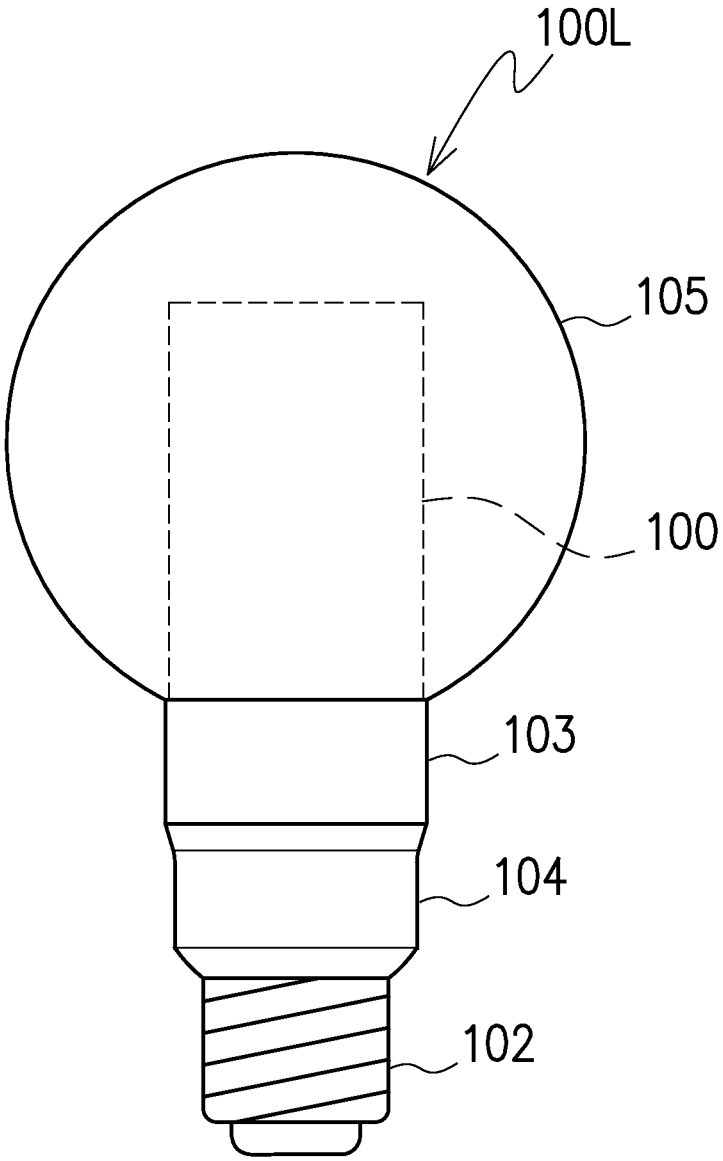
Fig. 9 (Prior Art)
FIG. 9 is a sectional view of a conventional lighting bulb.
Figure 10:
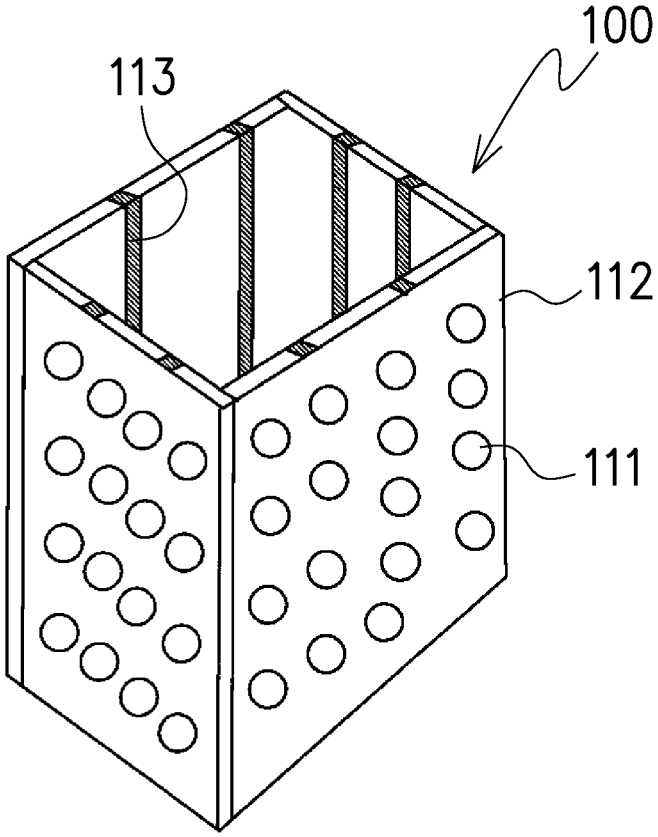
Fig. 10 (Prior Art)
FIG. 10 is a perspective view of an LED module disposed as a light source of the lighting bulb as shown in FIG. 9.
Figure 11:
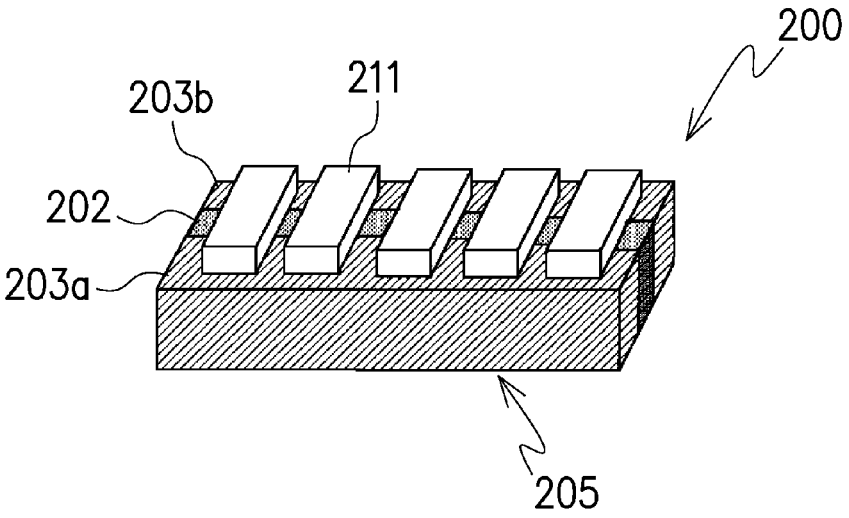
Fig. 11 (Prior Art)
FIG. 11 is a perspective view showing one example of a module as a light source of a conventional lighting device.
Figure 12:
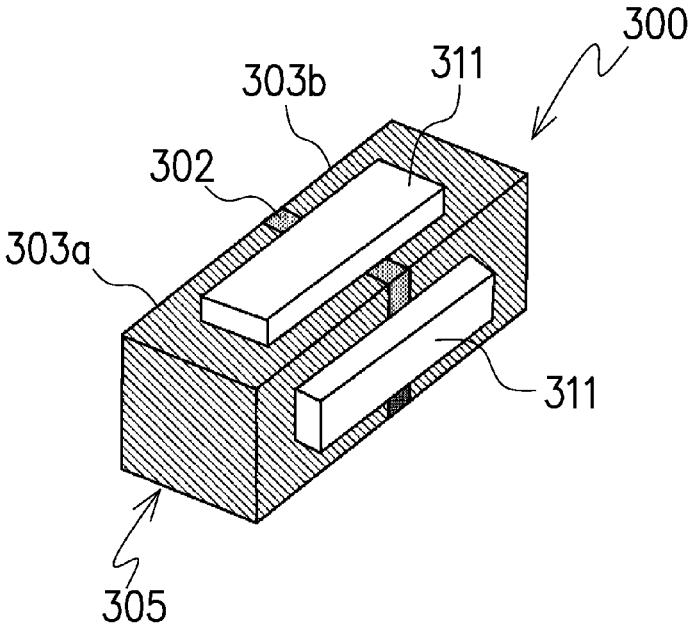
Fig. 12 (Prior Art)
FIG. 12 is a perspective view showing another example of a module as a light source of a conventional lighting device.

As shown in FIG. 8, for example, it is possible to apply an electrode-assembly in a plate shape to a light source 12" in a lighting tube 50L as a lighting device. In this lighting tube 50L, a plurality of light-emitting elements 11 may be provided on only a first surface of the plate shape of an electrode-assembly 10" or may be provided on a first surface and a second surface that is positioned at an opposite side of the first surface of the electrode-assembly 10". The first electrode 13" and the second electrode 14" combined and electrically insulated by the insulating layer 15" of the electrode assembly 10" can be an elongated shape that conforms with an elongated shape of the lighting tube 50L, because with the addition of the projection 13*a*, 14*a* and the depression 13*b*, 14*b* of the first electrode 13 and the second electrode 14, it is possible to increase the number of the light-emitting elements 11 that are aligned on the electrode-assembly 10" in a straight line extended in accordance with the elongated shape of the lighting tube 50L. The first electrode 13" is a metal plate and the second electrode 14" is also a metal plate. The upper cover 5" may be a tube-shaped cover covering the light source 12" from above a second end 10*b*" of the electrode assembly 10" included in the light source 12". In this embodiment, the lower cover 3' including an opening passing through the lower cover 3' from an upper side 3*a*' to a lower side 3*b*' of the lower cover 3'. The first end 10*a*" of the elongated shape of the electrode assembly 10" is inserted in the opening of the lower cover 3' from the upper side 3*a*' of the lower cover 3'. The lower cover 3' may be made from a metal or may include a metallic portion that is thermally connected to the light-emitting element 11. The upper side 3*a*' of the lower cover 3' may include a light-reflecting surface to reflect light from the light source 12" upward. The light-reflecting surface can be formed by a polished surface of the metallic portion provided on the upper side 3*a*' of the lower cover 3'. Also, a base 2' is positioned adjacent to the lower side 3*b*' of the lower cover 3'. The base 2' includes an insulating portion, and further includes a first terminal 2*a*' and a second terminal 2*b*' that are configured to be two pins.

The embodiments, variations, and examples set forth herein were presented to explain the nature of the present invention and its practical application, and thereby to enable those of ordinary skill in the art to make and use the invention. However, those of ordinary skill in the art will recognize that the foregoing description, variations, and examples have been presented for the purposes of illustration and example only. The description as set forth is not intended to be exhaustive or to limit the invention to the precise form disclosed. Many modifications and variations are possible in light of the teachings above without departing from the spirit and scope of the Claims. One skilled in the art will recognize that the invention may potentially be applied to many and various types of light sources and lighting devices including the light sources.

What is claimed is:

1. A light source comprising:

an electrode-assembly comprising a first electrode including a projection and a depression, a second electrode including a projection and a depression, and an insulating layer disposed between the first electrode and the second electrode to configure the electrode assembly in a shape of a rectangular parallelepiped; and two or more light-emitting elements, each of the two or more light-emitting elements with a p-electrode and a n-electrode arranged on the electrode-assembly to straddle the insulating layer of the electrode-assembly, the p-electrode and the n-electrode of each of the two or more light-emitting elements being electrically disposed on the projection of the first electrode and on the projection of the second electrode of the electrode-assembly that has the shape of a rectangular parallelepiped, the projection of the first electrode fitting in the depression of the second electrode on contact with the insulating layer and the projection of the second electrode fitting in the depression of the first electrode on contact with the insulating layer to configure the electrode-assembly, and the two or more light-emitting elements being arranged on two or more surfaces of the electrode-assembly that has the shape of the rectangular parallelepiped.

2. A light source comprising:

an electrode-assembly comprising a first electrode including projections and depressions, and a second electrode including projections and depressions, an insulating layer disposed between the first electrode and the second electrode to configure the electrode assembly in a shape of a rectangular parallelepiped; and light-emitting elements, each with a p-electrode and a n-electrode being arranged on the electrode-assembly to straddle the insulating layer of the electrode-assembly, and the p-electrode and the n-electrode of each of the light-emitting elements being disposed on each of the projections of the first electrode and on each of the projections of the second electrode of the electrode-assembly that has the shape of a rectangular parallelepiped, the projections of the first electrode fitting in the depressions of the second electrode on contact with the insulating layer, and the projections of the second electrode fitting in the depressions of the first electrode on contact with the insulating layer to configure the electrode-assembly, and the light-emitting elements being arranged on two or more surfaces of the electrode-assembly that has the shape of the rectangular parallelepiped.

3. The light source according to claim 2:

wherein the electrode-assembly includes the first electrode, the second electrode, and the insulating layer sandwiched by the first electrode and the second electrode, and the electrode-assembly includes an elongated shape with a first end and a second end that is positioned at an opposite side of the first end of the elongated shape of the electrode-assembly.

4. The light source according to claim 3:

wherein the electrode-assembly includes the first end, the second end at the opposite side of the first end, and peripheral side surfaces between the first end and the second end.

5. The light source according to claim 4:

wherein the light-emitting elements that straddle the insulating layer and are mounted on the projections of the first electrode and on the projections of the second electrode are aligned in a straight line at a first side surface of the peripheral side surfaces of the electrode-assembly.

6. The light source according to claim 5:

wherein the light-emitting elements that straddle the insulating layer of the electrode-assembly are mounted on the projections of the first electrode and on the projections of the second electrode are aligned in a straight line at a second side surface that is positioned at an opposite side of the first side surface of the peripheral side surfaces of the electrode assembly.

7. The light source according to claim 6 further comprising:

one or more of the light-emitting elements straddling the insulating layer of the electrode-assembly and being mounted on the first electrode and the second electrode at the second end of the elongated shape of the electrode-assembly.

8. The light source according to claim 1:

wherein the light-emitting element is a light-emitting diode element.

9. The light source according to claim 1:

wherein the light-emitting element is a light-emitting package including a substrate with an anode electrode and a cathode electrode and including a light-emitting diode element that is mounted on the substrate and electrically connected to the anode electrode and the cathode electrode of the substrate.

10. The light source according to claim 2:

wherein the light-emitting elements are light-emitting diode elements.

11. The light source according to claim 2:

wherein the light-emitting elements are light-emitting packages each including a substrate with an anode electrode and a cathode electrode and including a light-emitting diode element that is mounted on the substrate and electrically connected to the anode electrode and the cathode electrode of the substrate.

12. A lighting device comprising:

a base including a first terminal and a second terminal;

the light source according to claim 1; and the first electrode of the light source configured to be electrically connected to the first terminal of the base and the second electrode of the light source configured to be electrically connected to the second terminal of the base.

13. A lighting device comprising:

the light source according to claim 3;

an upper cover covering from above the second end of the elongated shape of the electrode-assembly included in the light source;

a lower cover being positioned at the first end of the elongated shape of the electrode-assembly included in the light source; and the lower cover including an opening passing through the lower cover from an upper side to a lower side of the lower cover, and the first end of the elongated shape of the electrode-assembly included in the light source being inserted in the opening of the lower cover from the upper side of the lower cover.

14. The lighting device according to claim 13, wherein the lower cover is made from a metal.

15. The lighting device according to claim 13, wherein the upper cover is made from a material selected from glass and resin.

16. The lighting device according to claim 14 further comprising:

a connector including a first terminal and a second terminal and being positioned in the opening of the lower cover to receive the first end of the elongated shape of the electrode-assembly included in the light source; and a circuit being positioned under the connector in the opening of the lower cover and electrically connected to the first terminal and the second terminal of the connector.

17. The lighting device according to claim 16, wherein the circuit includes a converter circuit that converts alternating current to direct current that is configured to be supplied to the connector.

18. The lighting device according to claim 14 further comprising:

a circuit being positioned in the opening of the lower cover, and electrically connected to the first electrode and the second electrode of the electrode-assembly included in the light source.

19. The lighting device according to claim 18, wherein the circuit includes a converter circuit that converts alternating current to direct current that is configured to drive the light-emitting elements mounted on the first-electrode and the second electrode of the electrode-assembly included in the light source.

20. The lighting device according to claim 17 further comprising:

a base being positioned under the circuit at the lower side of the lower cover and positioned outside the opening of the lower cover, and the base further including a first terminal and a second terminal configured to supply the alternating current to the circuit.

21. The lighting device according to claim 12 further comprising:

a substrate including a first wiring electrode and a second wiring electrode, wherein the light source is disposed on an upper surface of the substrate, the first electrode of the electrode-assembly included in the light source is electrically connected to the first wiring electrode of the substrate by soldering, and the second electrode of the electrode-assembly included in the light source is electrically connected to the second wiring electrode of the substrate by soldering.

22. The lighting device according to claim 13 further comprising:

a base being positioned adjacent to the lower side of the lower cover and positioned outside the opening of the lower cover, the base further including a first terminal and a second terminal that are configured to be two pins.

23. The lighting device according to claim 16:

wherein the connector is thermally connected to the lower cover and configured to release heat generated from the light source.

24. A lighting device comprising:

a light source including an electrode-assembly comprising a first electrode including projections and depressions, a second electrode including projections and depressions, an insulating layer disposed between the first electrode and the second electrode to configure the electrode assembly in a shape of a rectangular parallelepiped, and light-emitting elements each with a p-electrode and a n-electrode being arranged on the electrode-assembly to straddle the insulating layer of the electrode-assembly and disposed on each of the projections of the first electrode and on each of the projections of the second electrode, and wherein the projections of the first electrode fit in the depressions of the second electrode on contact with the insulating layer, and the projections of the second electrode fit in the depressions of the first electrode on contact with the insulating layer to configure the electrode assembly that has the shape of a rectangular parallelepiped;

an upper cover covering from above the second end of the elongated shape of the electrode-assembly included in the light source;

a lower cover being positioned at the first end of the elongated shape of the electrode-assembly included in the light source; and wherein the lower cover includes an opening that passes through the lower cover from an upper side to a lower side of the lower cover, and the first end of the elongated shape of the electrode-assembly included in the light source being inserted in the opening of the lower cover from the upper side of the lower cover, the light-emitting elements being arranged on two or more surfaces of the electrode-assembly that has the shape of the rectangular parallelepiped.

25. The lighting device according to claim 13, wherein the lower cover includes a metallic portion.

* * * * *